US007543569B2

(12) United States Patent
Remele et al.

(10) Patent No.: US 7,543,569 B2
(45) Date of Patent: Jun. 9, 2009

(54) ARRANGEMENT FOR CONTROLLING AN INTERNAL COMBUSTION ENGINE

(75) Inventors: Jŏrg Remele, Hagnau (DE); Uwe Rödl, Friedrichschafen (DE); Andreas Schneider, Friedrichshafen (DE); Albrecht Debelak, Graz (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/983,988

(22) Filed: Nov. 13, 2007

(65) Prior Publication Data

US 2008/0147292 A1 Jun. 19, 2008

(30) Foreign Application Priority Data

Dec. 14, 2006 (DE) ..... 10 2006 059 006

(51) Int. Cl.
*F02M 51/00* (2006.01)
*F02M 51/06* (2006.01)

(52) U.S. Cl. ..... 123/478; 123/480

(58) Field of Classification Search ..... 123/472, 123/478–480, 488, 490, 494, 299, 300, 301, 123/430

See application file for complete search history.

(56) References Cited

U.S. PATENT DOCUMENTS 4,386,522 A * 6/1983 Wolff ..... 73/114.47
4,667,511 A * 5/1987 Mausner ..... 73/114.47

FOREIGN PATENT DOCUMENTS

| | | |
|---|---|---|
| DE | 199 43 917 | 3/2001 |
| DE | 101 17 809 | 10/2002 |
| EP | 1 203 881 | 5/2002 |
| WO | WO 97/23717 | 7/1997 |

* cited by examiner

*Primary Examiner*—Mahmoud Gimie
(74) *Attorney, Agent, or Firm*—Klaus J. Bach

(57) ABSTRACT

In an arrangement for controlling an internal combustion engine comprising an electronic engine control unit, a fuel injector, electronic connecting lines extending between the electronic engine control unit and the injector and an intelligent electronic block forming with the injector a component unit, the intelligent electronic block comprises an electronic data storage device, a computing unit, an energy storage device for storing energy and supplying energy to the intelligent electronic block and also a measuring unit for detecting the movement of an injector needle as an indication of fuel injection begin and fuel injection end.

6 Claims, 1 Drawing Sheet

ARRANGEMENT FOR CONTROLLING AN INTERNAL COMBUSTION ENGINE

BACKGROUND OF THE INVENTION

The present invention resides in an arrangement for controlling an internal combustion engine having a cylinder with a combustion chamber and comprising an electronic control unit, at least one injector for the injection of fuel into the combustion chamber, and connecting lines extending between the electronic engine control unit and the injector for the transmission of signals and an intelligent electronic component.

In an internal combustion engine, the fuel injection begin and the fuel injection end determines largely the composition of the exhaust gas. In order to keep the exhaust gas composition within the legal limits those two characteristic values are generally controlled by an electronic engine control unit.

However, in the praxis, in an internal combustion engine with a common rail fuel injection system, there is always a time delay between the beginning of the energization of the injector, the movement of the control needle of the injector and the actual fuel injection. The same applies to the end of the fuel injection. In addition, there are deviations between the individual injectors and also aging effects which affect the operation of the fuel injectors overall.

In order to reduce such deviations, the manufacturing data of the injectors are recorded by a coding applied to each injector for example by means of bar codes or code numbers. The data are then read by a corresponding reading apparatus into the electronic engine control unit. Another possibility is to record the individual parameters of an injector in a memory component which is arranged at the injector. During operation, these parameters are read by the engine control unit and the desired control values are adapted to the particular injector. WO 97/23717 A discloses such a system with a passive memory component, that is, a memory component which does not require an energy supply. For reading out the parameters, however, corresponding signal transmission lines are necessary.

For determining the momentary state of the injector, generally the position of the injector needle is detected inductively by a change of the PWM signal via a travel sensor or opto-electronically. Also in this case, the wiring expenditures are critical.

It is the object of the present invention to provide means for a reliable determination of the momentary state of an injector with little cabling expenditures.

SUMMARY OF THE INVENTION

In an arrangement for controlling an internal combustion engine comprising an electronic engine control unit, a fuel injector, electronic connecting lines extending between the electronic engine control unit and the injector and an intelligent electronic block forming with the injector a component unit, the intelligent electronic block comprises an electronic data storage device, a computing unit, an energy storage device for storing energy and supplying energy to the electronic block and also a measuring unit for detecting the movement of an injector needle as an indication of fuel injection begin and fuel injection end.

The movement of the injector needle is detected by way of an inductive or capacitive sensor or by a measuring unit, for example via a bridge circuit or an externally excited series oscillation circuit. In addition, a comparator with a follow-up comparator threshold is provided.

Energy is transferred from the electronic engine control unit to the energy storage device during fuel injection by way of the connecting lines. Generally the connecting lines are twisted-pair wires. During the injection pauses the energy storage device supplies energy to the electronic component. Only in this way, a bi-directional communication between the engine control unit and the injector is possible also in the injection pauses. The bi-directional signal transmission from the electronic control unit to the injector and the energy transmission occurs via the same transmission lines so that cable needs are reduced.

Generally, the advantage of the invention resides in the fact that a higher integrations degree with improved functionality and, at the same time, improved reliability is achieved.

The invention will become more readily apparent from the following description of a particular embodiment thereof on the basis of the accompanying drawings.

DESCRIPTION OF AN EMBODIMENT OF THE INVENTION

Figure 1:
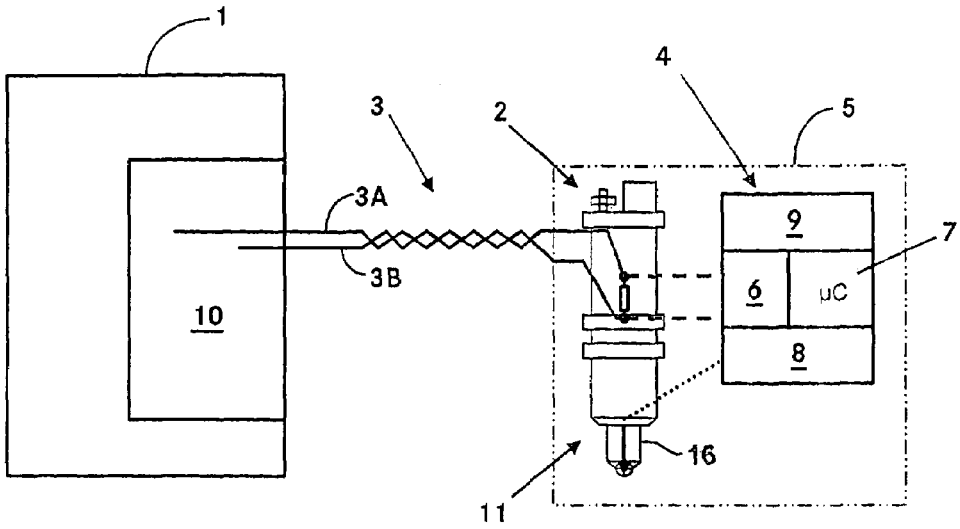
FIG. 1 shows schematically an overall arrangement.
Figure 2:
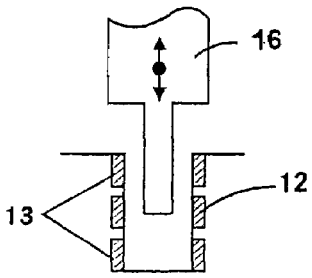
FIG. 2 shows a differential transformer for detecting inductivity changes.
Figure 3:
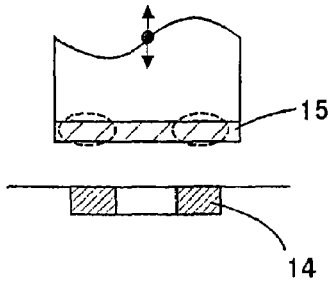
FIG. 3 shows an eddy current sensor for detecting inductivity changes.

In FIG. 1, the arrangement according to the invention is shown in an overview. It comprises the following components: An electronic engine control unit 1, connecting lines 3, an injector 2 and an intelligent electronic block 4, which forms a common component 5 together with the injector 2. As electronic component in the sense of the present invention, an electronic component group with semiconductor elements such as a microprocessor is to be understood which are arranged on a platelet or substrate and, optionally, comprises a housing including a vibration and temperature protection. The connecting lines 3 are in the form of twisted pair cables 2-wire conductors 3A and 3B. By means of a sensor 11, the needle stroke of the injector 2 is detected. The sensor 11 may be in the form of a differential transformer with a primary coil 12 and two secondary coils 13 as shown in FIG. 2 or in the form of an eddy current receiver with a flat coil 14 and a conductive plate 15 so as to be inductive as shown in FIG. 3. Alternatively, the sensor 11 may be a capacitive receiver. Such sensors and their principle of operation are known to the person skilled in the art and do not need to be explained in detail.

The electronic block 4 includes an electronic storage unit 6 for storing data, a computing unit 7 with a microprocessor, an energy storage device 9 and a measuring unit 8. The measuring unit 8 includes a corresponding bridge circuit for detecting inductivity or capacity changes. The person skilled in the art is familiar with such bridge circuits, for example a Wien/Maxwell bridge circuit, so that these devices do not need to be described in detail. Alternatively, the measuring unit 8 may form, together with the sensor 11, an externally excited series oscillation circuit. The evaluation of the signals, that is the conversion of the measured inductivity or capacitance values to a time signal, occurs in the computation unit 7.

The arrangement operates as follows:

The injector 2 is activated (injection begin) or deactivated (injection end) by the engine control unit 10 via the connecting lines 3. At the beginning of the energization of the injector 2 for example an inductivity measurement is performed by the measuring unit 8. After activation of the injector 2, the position of the injector needle 16 begins to change. This position change is detected by the sensor 11 and is evaluated by the measuring unit 8 in connection with the computation unit 7. The starting point in time for the movement of the injector needle, the stopping point in time of the injector needle and, consequently, the opening duration of the injector can be exactly determined.

At the same time, with the activation of the injector 2, the energy transmission from a final stage 10 of the electronic engine control unit 1 via the connecting lines 3 to the energy storage device 9 begins. During the fuel injection, the energy storage device 9 is charged. With the deactivation of the injector 2, the energy transmission is also terminated. During the injection pause, the electronic block 4 is supplied with energy from the energy storage device 9. In this way, a bi-directional communication can be established also during the injection pause. For example, the electronic engine control unit 1 can read out the individual injector data from the storage unit 6 and adapt the control parameters, if necessary complete the data in the storage unit 6 with new parameters and cause the measuring unit 8 to perform additional measurements.

From the above description, it is apparent that the invention provides for the following advantages:

the momentary state of the injector with respect the injection begin and injection end can be accurately determined, The cabling needs are reduced to two cables, the intelligent injector has a high degree of integration.

What is claimed is:

1. An arrangement for controlling an internal combustion engine having a cylinder with a combustion chamber and comprising: an electronic engine control unit (1), a fuel injector (2) for the injection of fuel into the combustion chamber, connecting lines (3) extending between the electronic engine control unit (1) and the injector (2) with an injector needle (16), and an intelligent electronic block (4) forming with the injector (2) a component unit (5), said electronic block (4) comprising an electronic data storage device (6) for the storage of data, a computing unit (7), an energy storage device (9) for storing electric energy and for supplying energy to the electronic block (4) during operation of the internal combustion engine in injection pauses, and also a measuring unit (8) for detecting the movement of the injector needle (16) by way of an inductive or capacitive measuring procedure and transmitting measuring signals to the engine control unit (1) via the connecting lines (3) during the injection pauses while the electronic block (4) is energized by the energy storage device (9).

2. The arrangement according to claim 1, wherein the measuring unit (8) comprises a bridge circuit for detecting the inductivity or capacitance changes caused by movement of the injector needle (16).

3. The arrangement according to claim 1, wherein the measuring unit (8) comprise a series oscillation circuit for detecting the inductivity or capacitance changes caused by movement of the injector needle (16).

4. The arrangement according to claim 1, wherein a differential transformer or an eddy current receiver is provided for detecting the inductivity changes.

5. The arrangement according to claim 2, wherein the measuring unit (8) comprises a comparator with a follow-up comparator threshold.

6. The arrangement according to claim 3, wherein the measuring unit (8) comprises a comparator with a follow-up comparator threshold.

* * * * *